United States Patent [19]

Watanabe et al.

[11] Patent Number: 4,760,312

[45] **Date of Patent: * Jul. 26, 1988**

[54] DENSE SILICON CARBIDE MICROWAVE ABSORBER FOR ELECTRON LINEAR ACCELERATOR

[75] Inventors: Masakazu Watanabe; Akiyasu Okuno, both of Aichi, Japan

[73] Assignee: NGK Spark Plug Co., Ltd., Aichi, Japan

[ * ] Notice: The portion of the term of this patent subsequent to Jan. 20, 2004 has been disclaimed.

[21] Appl. No.: 826,463

[22] Filed: Feb. 5, 1986

Related U.S. Application Data

[63] Continuation-in-part of Ser. No. 520,280, Aug. 4, 1983, abandoned.

[30] Foreign Application Priority Data

Aug. 4, 1982 [JP] Japan ..... 135205

[51] Int. Cl.[4] ..... H01P 1/26

[52] U.S. Cl. ..... 315/5.41; 315/39; 333/81 R; 333/81 B; 333/22 F; 333/22 R; 501/88

[58] Field of Search ..... 315/39, 5.41; 333/81 R, 333/81 B, 251, 211, 22 F, 22 R; 501/88

[56] References Cited

U.S. PATENT DOCUMENTS

| | | | |
|---|---|---|---|
| 3,634,566 | 1/1972 | Gates, Jr. et al. | 501/88 |
| 3,868,602 | 2/1975 | Meddaugh | 333/81 B |
| 4,004,934 | 1/1977 | Prochazka | 264/65 |
| 4,190,757 | 2/1980 | Turpin et al. | 219/10.55 E |
| 4,336,216 | 6/1982 | Watanabe et al. | 264/65 |
| 4,477,746 | 10/1984 | Piltch | 315/39 |
| 4,638,268 | 1/1987 | Watanabe et al. | 333/22 F |
| 4,661,787 | 4/1987 | Lang | 333/22 R |

FOREIGN PATENT DOCUMENTS

| | | | |
|---|---|---|---|
| 0028802 | 5/1981 | European Pat. Off. | 501/88 |
| 2414256 | 9/1979 | France | 333/22 F |
| 0047750 | 4/1978 | Japan | 333/22 R |

*Primary Examiner*—David K. Moore
*Assistant Examiner*—Michael J. Nickerson
*Attorney, Agent, or Firm*—Sughrue, Mion, Zinn, Macpeak & Seas

[57] ABSTRACT

A microwave absorber composed of dense silicon carbide having an electrical resistivity of one ohm-centimeter or more. In an electron linear accelerator, it is necessary to provide a microwave absorber to absorb excess energy used to accelerate electrons and discharge this excess energy in the form of heat in order for the accelerator to operate safely. The important characteristics are high-frequency wave absorption, good heat resistance, good thermal conductivity, and stability in a vacuum. The invention meets these requirements with a microwave absorber composed of dense silicon carbide. In an electron linear accelerator the absorber is attached to the end portion of an accelerator guide or a branch portion of a power divider to absorb unnecessary wave energy. Such a microwave absorber is found to have characteristics rendering it highly suitable for this application as well as others.

3 Claims, 2 Drawing Sheets

DENSE SILICON CARBIDE MICROWAVE ABSORBER FOR ELECTRON LINEAR ACCELERATOR

This application is a continuation-in-part of application Ser. No. 520,280, filed Aug. 4, 1983, entitled "MICROWAVE ABSORBER FOR ELECTRON LINEAR ACCLERATOR", now abandoned.

BACKGROUND OF THE INVENTION

An electron linear accelerator is a device in which large amounts of power at high frequencies are generated by a klystron and supplied to an accelerator guide where electrons are accelerated up to the velocity of light by means of an electric field produced in the accelerator guide. It is necessary to absorb the excess energy used for acceleration of the electrons and to discharge this excess energy in the form of Joule's heat to ensure safe operation of the electron linear acceleraor. It also is necessary to absorb returned power, in cases where a power divider is utilized, in order to protect a high-frequency generator such as a klystron from damage.

Usually, the following characteristics are required for a microwave absorber used in an electron linear accelerator:

(1) The absorption factor for microwave and other high-frequency energy must be large, and the variation of this factor must be small.

(2) Because the absorber is used in a vacuum of the order of $10^{-5}$ to $10^{-6}$ Pa, the absorber must be very dense to avoid gas release accompanied by discharge.

(3) The material of the absorber must be capable of withstanding high temperatures up to about 2000° C.

(4) The absorber must have a high thermal condutivity in order to rapidly discharge the absorbed thermal energy out of the system.

Conventional microwave absorbers made of manganese-zinc ferrite, nickel-zinc ferrite, etc., which have none of the above-mentioned features, are particularly inappropriate for use in an electron linear accelerator.

SUMMARY OF THE INVENTION

An object of the present invention is to provide an improved microwave absorber having the above-mentioned characteristics. Microwave absorbers made of dense silicon carbide and having an electrical resistivity of one ohm-centimeter or more have been found to remarkably conform to the above requirements. A microwave absorber using this material is attached to the end portion of the accelerator guide or to the branch portion of the power divider to thereby absorb unnecessary, harmful wave energy.

DETAILED DESCRIPTION OF THE INVENTION

Figure 1:
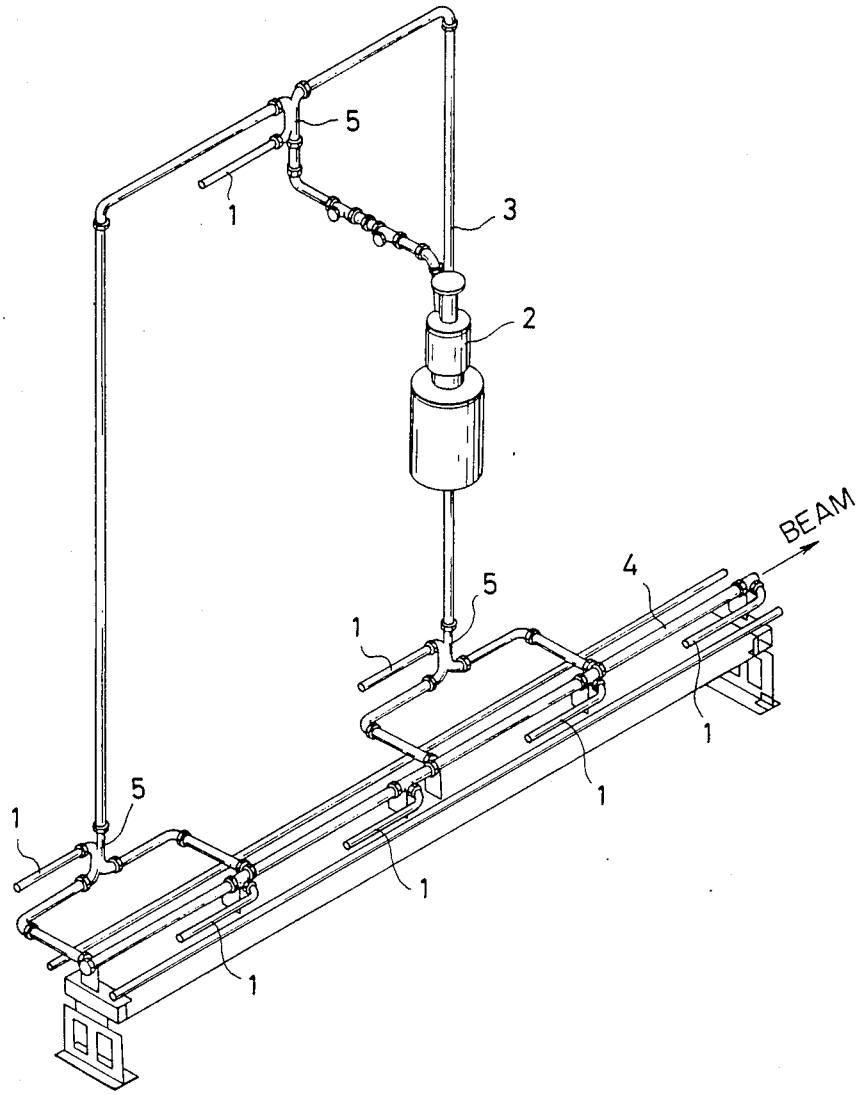
FIG. 1 is a schematic diagram of an electron linear accelerator to which a microwave absorber according to the present invention is attached.

Referring to FIG. 1, waveguides 1 containing dense silicon carbide microwave absorber therein are attached to an accelerator guide 4 and to power dividers 5 in an electron linear accelerator unit. A klystron 2 generates large power high-frequency energy to the accelerator guide 4 via a waveguide 3 through power dividers 5. When such power dividers 5 are used, it is necessary to protect the klystron 2 from energy returning to the klystron from the load. Typically, 40 electron linear accelerator units are connected to each other to constitute an electron linear accelerator. Dense silicon carbide having an electrical resistivity of 1 ohm-centimeter or more may be produced by a known method.

Figure 2:
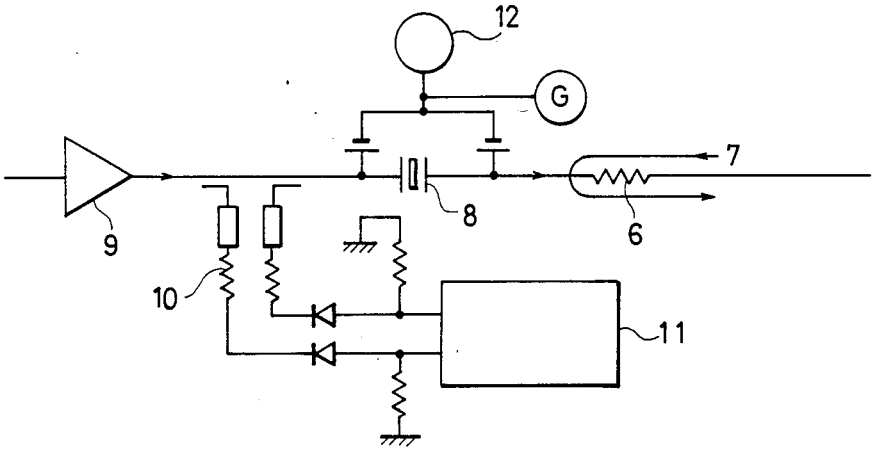
FIG. 2 is a circuit diagram for a high power electrical test of a klystron connected to the microwave absorber of the invention.

A high power electrical test was performed with a dense silicon carbide microwave absorber connected to the output of a klystron of 30 MW (max.) having a pulse width of 3 μsec and a frequency of 50 Ppps. In FIG. 2, a dense silicon carbide microwave absorber 6 receives high energy waves via a waveguide 8 from a klystron 9. The klystron was operated in a vacuum created by a vacuum pump 12, and the microwave absorber 6 was kept cool by circulating water 7 about it. Measurements were made utilizing an oscilloscope 11 and an attenuator 10.

The results of this test were as follows.

(1) Discharge was not observed and the discharge resistance of the absorber was sufficient for input powers in a range of 0 to 8 MW (max.) with a pulse width of 3 μsec and a frequency of 1 pps.

(2) The microwave absorber proved stable under high vacuum conditions. Except for gases or impurities contaminating the surface of the silicon carbide which were emitted into the region of the high-frequency electrical field immediately after the power test began at a pressure of $2\times10^{-6}$ Torr, no other breakdown occurred and the absorber was stabilized immediately.

Figure 3:
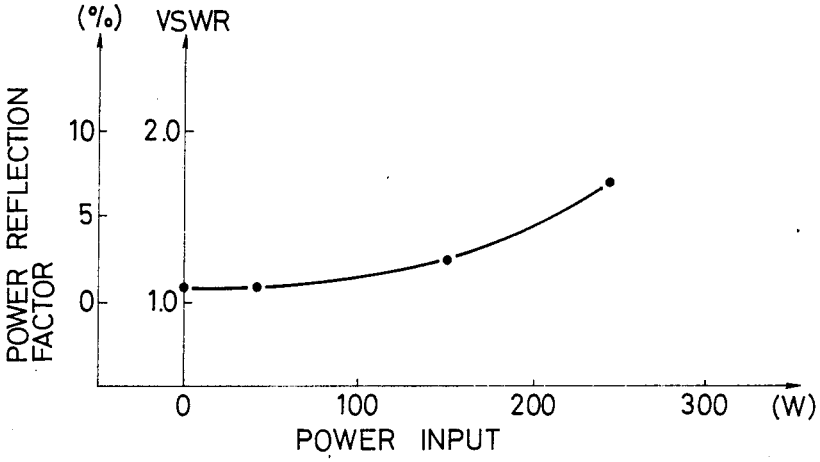
FIG. 3 is a graph illustrating the relationship between the supply power and voltage standing wave ratio measured with the microwave absorber of the invention.

(3) The wave-absorbing ability of the microwave absorber was determined by measuring the voltage standing wave ratio with a standard wave-measuring device. The voltage standing wave ratio and power reflection factor were obtained from the maximum amplitude ratio of the standing waves caused by the interference between the progressive and reflecting waves with a microwave input at 2,856±10 MHz at a maximum power of 240 watts. (4 MW, 20 pps, 3 μsec.) As shown in FIG. 3, as absorption factor of 90% or more was realized. As the power input was increased, however, the temperature of the material rose and the reflection factor increased somewhat, thereby lowering the absorption factor.

Furthermore, in an actual test employing a dense silicon carbide microwave absorber (entire length of 400 meters, $25\times10^8$ eV) in an actual electron linear accelerator as shown in FIG. 1 having a power input of 120 W (3 MW (max.)), 4 μsec, 10 pps), over the course of two months, it was confirmed that the absorber was stable with no change in appearance or wave absorption factor.

The microwave absorption and electrical resistivity characteristics of dense silicon carbide according to the present invention were found to be superior to that of various other materials. A test was performed on samples of various materials first measuring their electrical resistivity and then measuring their temperature after being exposed to microwave radiation for three minutes. Each test piece (4×8×24 mm) was placed in a microwave oven for three minutes and its temperature was measured by an infrared camera. The results are as shown in Table 1 below.

TABLE 1

| Material | Wave absorption characteristics (Absorption time three min.) Electrical Resistivity (Ω-cm) | Temperature |
|---|---|---|
| SiC (Dense) | $1 \times 10^5$ | 440° C. |
| SiC (Porous) | 2 | 370° C. |
| SiC − 10% Si | $3 \times 10^{-2}$ | 120° C. |
| $Al_2O_3$ | $1 \times 10^{13}$ | No temperature rise |
| Mo | $5 \times 10^{-6}$ | No temperature rise |

The results of this test show that the conductor material, Mo as well as the insulating material, $Al_2O_3$ have poor microwave absorption characteristics. On the other hand, silicon carbide, a semiconductor material, has good absorption characteristics with the densest silicon carbide having the highest resistivity of all samples tested. On the basis of these tests, dense silicon carbide is shown to be most appropriate for use in a microwave absorber.

The dense silicon carbide according to the present invention consists essentially of:

(1) from about 91.0 to about 99.8% by weight silicon carbide;

(2) from about 0.1 to about 6.0% by weight uncombined carbon; and (3) from about 0.1 to about 3.0% by weight at least one of the densification agents selected from the group consisting of B, $B_4C$, $AlB_2$, BN, $SiB_6$, BP, $Al_4C_3$, AlN and $Al_2O_3$, and has a density of at least about 95% of the theoretical density.

As described above, according to the present invention a microwave absorber of dense silicon carbide provides a high microwave absorption factor, high density, good heat resistance, and high thermal conductivity. These properties render it particularly useful in an electron linear accelerator. While this use is particularly described above, the invention is not intended to be limited to this application alone. Microwave absorbers according to the invention may be widely used for other devices including induction heating, devices for preventing TV picture ghost images from occurring, and other wave absorbing purposes.

We claim:

1. In an electron linear accelerator which includes a klystron used to generate high electrical energy to an electron beam accelerator guide via a waveguide and power dividers to distribute the energy provided via said waveguide to a head portion of every said accelerator guide, a microwave absorber attached to a branch portion of said power dividers and at an end portion of said accelerator guide, said microwave absorber consisting essentially of dense silicon carbide which is a semiconductor having an electrical resistivity of at least 1 ohm-centimeter, said dense silicon carbide having an electrical resistivity in a range of 1 to $10^5$ ohm-centimeter.

2. A microwave absorber as claimed in claim 1, wherein said dense silicon carbide is more than 95% as dense as the theoretical density.

3. A microwave absorber as claimed in claim 1 or 2, wherein said dense silicon carbide consisting essentially of:

from about 91 to about 99.8% by weight silicon carbide;

from about 0.1 to about 6.0% by weight uncombined carbon; and from about 0.1 to about 3.0% by weight at least one of the agents selected from the group consisting of B, $B_4C$, $AlB_2$, BN, $SiB_6$, BP, $Al_4C_3$, AlN and $Al_2O_3$.

* * * * *